US009694297B2

(12) United States Patent
McMahon

(10) Patent No.: US 9,694,297 B2
(45) Date of Patent: Jul. 4, 2017

(54) SNOW BLOCK ERECTOR SET

(71) Applicant: Joseph M. McMahon, Webster, NY (US)

(72) Inventor: Joseph M. McMahon, Webster, NY (US)

( * ) Notice: Subject to any disclaimer, the term of this patent is extended or adjusted under 35 U.S.C. 154(b) by 0 days.

(21) Appl. No.: 15/356,570

(22) Filed: Nov. 19, 2016

(65) Prior Publication Data

US 2017/0144080 A1 May 25, 2017

Related U.S. Application Data

(60) Provisional application No. 62/258,017, filed on Nov. 20, 2015.

(51) Int. Cl.

| | |
|---|---|
| ***F25C 1/22*** | (2006.01) |
| ***A63H 33/00*** | (2006.01) |
| ***A63H 33/32*** | (2006.01) |
| ***B28B 7/00*** | (2006.01) |

(52) U.S. Cl.

CPC ..... *A63H 33/001* (2013.01); *A63H 33/32* (2013.01); *F25C 1/22* (2013.01); *Y10S 425/057* (2013.01)

(58) Field of Classification Search

CPC ... A63H 33/001; A63H 33/32; Y10S 425/057; F25C 1/22

USPC ..... 425/DIG. 57, 318; 249/66.1, 117, 126, 249/141, 163, 165, 166, 168; 264/33; 446/70

See application file for complete search history.

(56) References Cited

U.S. PATENT DOCUMENTS 1,610,121 A * 12/1926 Dickinson ..... A63H 33/001 249/142
1,639,934 A * 8/1927 Ferring ..... A63H 33/001 249/165
2,752,631 A * 7/1956 Wendt ..... A63H 33/001 294/54.5
3,572,625 A * 3/1971 Williamsen ..... F25C 1/22 164/131
3,685,942 A * 8/1972 Shaffer ..... B44C 5/00 249/141
3,717,431 A * 2/1973 Matsuda ..... A63H 33/001 425/318
3,816,048 A * 6/1974 Berry ..... B28B 7/0038 249/160
3,838,633 A * 10/1974 Newell ..... E01H 5/00 100/39
3,848,846 A * 11/1974 Ebner ..... A63H 33/04 249/117
4,154,423 A * 5/1979 Crock ..... B28B 7/0029 249/117

(Continued)

*Primary Examiner* — Alexander Niconovich
(74) *Attorney, Agent, or Firm* — Tracy Jong Law Firm; Tracy P. Jong; Cheng Ning Jong

(57) ABSTRACT

A snow block erector set including a pair of substantially rectangular side walls, each side wall having a top edge, a bottom edge two side edges, an outside surface and an inside surface, each side edge of each side wall connecting one end of the top edge of each side wall to one end of the bottom edge of each side wall to form a top corner and a bottom corner, respectively, an aperture and lock pair disposed substantially on each of the top corners; a pair of substantially rectangular end walls, each end wall having two side edges; a pair of brace bars, each having two ends; and a channel disposed substantially along each side edge on the inside surface of each of the substantially rectangular side walls.

20 Claims, 10 Drawing Sheets

(56) References Cited

U.S. PATENT DOCUMENTS 4,725,036 A * 2/1988 Brandon ..... A23G 9/221 249/164
4,842,241 A * 6/1989 Fitzgerald ..... B28B 7/0044 249/134
5,240,223 A * 8/1993 Welch ..... B29C 33/0011 249/134
5,632,926 A * 5/1997 Dyer, Jr. ..... A63H 33/001 249/121
5,817,248 A * 10/1998 Forlini ..... B28B 7/0044 249/102
5,895,304 A * 4/1999 Dixon ..... A63H 33/32 249/83
6,083,072 A * 7/2000 Brooks ..... A63H 33/32 249/59
6,176,464 B1 * 1/2001 Harvey ..... A63H 33/001 249/126
7,000,887 B1 * 2/2006 Mulhern ..... F25C 3/00 249/155
7,601,069 B2 * 10/2009 Freres ..... A63G 31/00 446/106
7,727,430 B1 * 6/2010 Wilson ..... E04B 1/00 264/32
8,100,380 B2 * 1/2012 Goertzen ..... E04B 1/3211 249/117
8,556,740 B1 * 10/2013 Schneider ..... A63H 33/32 446/465
9,186,824 B2 * 11/2015 Klaves ..... B29C 41/003
9,474,986 B2 * 10/2016 Drylie ..... A63H 33/001
2008/0251687 A1 * 10/2008 Taufield ..... A63H 33/32 249/61
2008/0307680 A1 * 12/2008 Schlichting ..... B30B 11/02 37/225
2010/0230576 A1 * 9/2010 Pendergast ..... A63H 33/32 249/140
2010/0230842 A1 * 9/2010 Pendergast ..... B44C 3/04 264/33
2013/0069265 A1 * 3/2013 Djoboulian ..... E04G 11/22 264/33

* cited by examiner

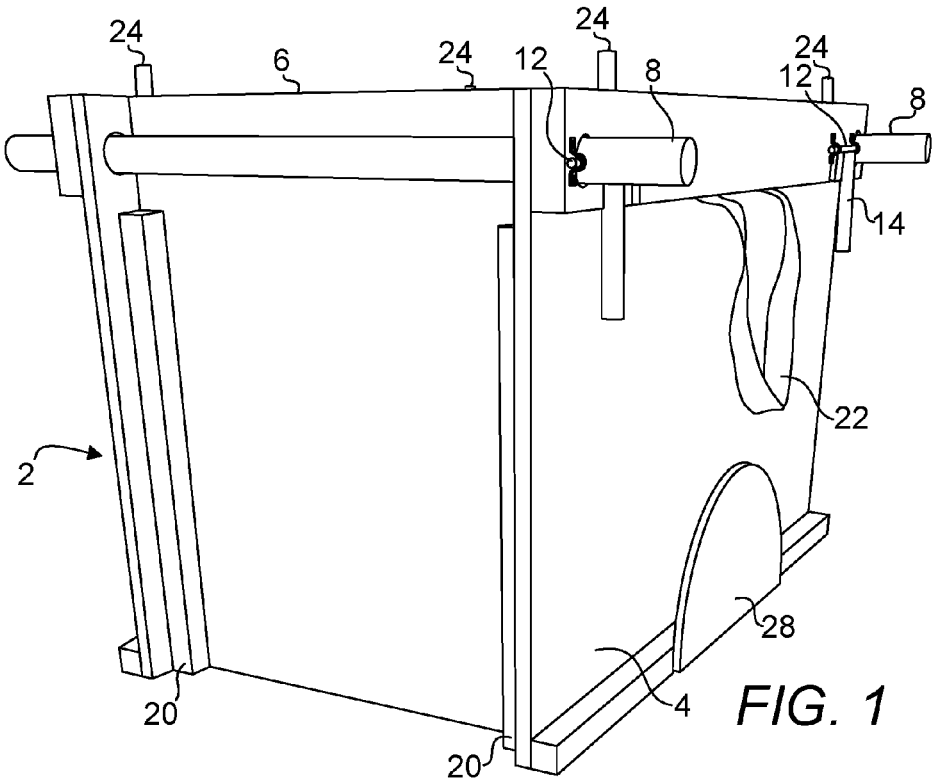
FIG. 1
FIG. 2
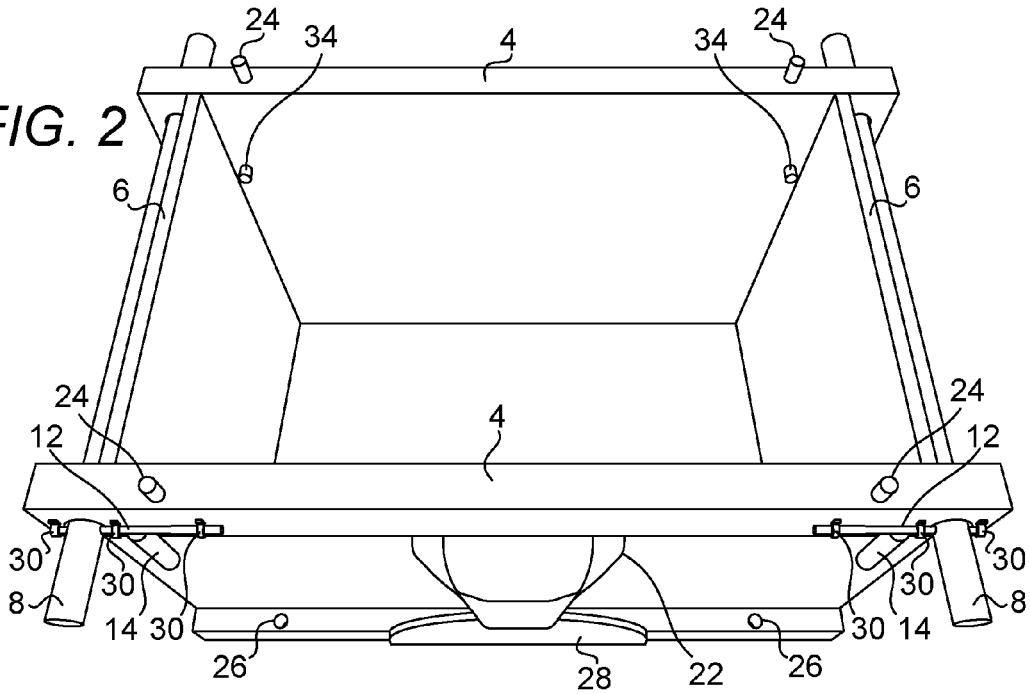

SNOW BLOCK ERECTOR SET

PRIORITY CLAIM AND RELATED APPLICATIONS

This non-provisional application claims the benefit of priority from application U.S. Ser. No. 62/258,017 filed on Nov. 20, 2015. Said application is incorporated by reference in its entirety.

BACKGROUND OF THE INVENTION

1. The Field of the Invention

The present invention is directed generally to a snow block erector set. More specifically, the present invention is directed to a snow block erector set capable of aiding in forming large snow blocks at more than one level.

2. Background Art

U.S. Pat. No. 3,816,048 to Berry et al. (Hereinafter Berry) discloses a two-piece mold for producing shaped units of formable material such as snow and the like, and for handling and positioning the shaped units. One piece of the mold provides three sides and at least one open end, and the second piece provides the fourth side and an end closure. The two mold pieces are slidably mated along their edges to an assembled condition in which the first and second pieces are secured to provide an open topped, closed bottom mold. After snow or other shape-holding material is packed into the mold through the open top, and sets its shape, the filled mold is inverted. With the second piece held in place, the three-sided element is drawn past the fixed end closure which is now positioned at the top until the three-sided element is separated. The second element including the end closure is moved laterally from the resulting block of shaped material to leave the shaped unit standing free where initially positioned. The first and second elements of the mold can then be mated for reuse. Berry's mold does not permit the removal of each side wall or end wall from a formed snow block individually so as not to disturb the formed snow block. In addition, Berry requires inversion of its mold to release the formed snow block.

U.S. Pat. No. 3,685,942 to Shaffer (Hereinafter Shaffer) discloses a device and method for use in producing compacted blocks of snow which can be assembled and shaped into sculptured works or other snow structures, the device comprising a scoop in the nature of an open ended mold having four tapered closed sides and a proximal end wall defining a mold cavity. The proximal end wall contains air holes and a handle to be gripped by the user. Snow blocks are formed in a continuous manner by forcing the open end of the scoop into snow, compacting the snow in the mold cavity of the scoop when the scoop is full of snow by pushing the scoop toward the ground into more snow and jarring the compacted snow from the mold cavity after elevating the scoop. Again, Shaffer's block does not permit the removal of each side wall or end wall from the formed snow block individually so as not to disturb the formed snow block.

U.S. Pat. No. 3,572,625 to Willliamsen (Hereinafter Willliamsen) discloses a mold for forming blocks of snow including four right angularly related walls, an open top and an open bottom. One of the walls is slightly inclined outward so as to facilitate the removal of the block. Two of the opposed walls are provided with bumpers to enable a bouncing of the mold in shaking the block loose therefrom. Williamsen's mold is designed be held by hand such that it can be shaken to release the formed block. The present snow mold is capable of holding much more snow for making a much larger block and therefore is not suitable to be held in hand. Williamsen's mold also does not permit the removal of each side wall or end wall from the formed snow block individually so as not to disturb the formed snow block.

U.S. Pat. Pub. No. 2010/0230842 of Pendergast (Hereinafter Pendergast) discloses a four-sided open top forming mold body for material such as snow or sand having peripheral walls with in-turned flanges at a bottom thereof, a mold bottom adapted to rest against the in-turned flanges, inter-engaging edge portions of the bottom and configurations on the walls retaining the bottom in place until application of a force sufficient to overcome the retention whereby the bottom can push the molded material out of the mold, and the bottom can be re-snapped into position at the bottom before another material molding, the mold body adapted to receive an open ended receptacle such as a sandbag having a greater length than the height of the mold such that the receptacle open end can be closed when the receptacle is filled with material to the top of the mold. Pendergast's mold also does not permit the removal of each side wall or end wall from the formed snow block individually so as not to disturb the formed snow block.

U.S. Pat. No. 4,154,423 to Crock (Hereinafter Crock) discloses two molds, each comprising an open top container having side walls, end walls, and a bottom, are provided for forming blocks of snow or ice which are used to form a complete domed structure such as an igloo. The configuration of one mold is such that blocks formed by it will fit together to form a circular upwardly converging wall, and the configuration of the other mold is such that blocks formed by it will fit together to form a circular dome which rests on the upper surface of the wall to complete the structure. Crock discloses molds suitable for making blocks of a particular shape for building an igloo. Once formed, the blocks of Crock can only be released by inverting the molds.

Thus, there is a need for a snow block erector set adapted for the construction of large snow blocks where the erector set is transportable and set up without undue effort. There should also be no inversion of snow blocks to position the snow block in place.

SUMMARY OF THE INVENTION

In accordance with the present invention, there is provided a snow block erector set including:

(a) a pair of substantially rectangular side walls, each side wall having a top edge, a bottom edge, two side edges, an outside surface and an inside surface, each side edge of a side wall connecting one end of the top edge of each side wall to one end of the bottom edge of each side wall to form a top corner and a bottom corner, respectively, an aperture and lock pair disposed substantially on each top corner;

(b) a pair of substantially rectangular end walls, each end wall having two side edges; and (c) a pair of brace bars, each brace bar having two ends and two retainers, each retainer disposed substantially on one of the two ends of each brace bar, wherein the side walls are configured to be aligned in parallel with their inside surfaces facing one another and each aperture of one of the aperture and lock pairs of one of the side walls is substantially aligned with an aperture of one of the aperture and lock pairs of the other one of the side walls, each end of each brace bar is configured to be inserted through one of the aligned apertures and removably secured in place with a lock of each aperture and lock pair deployed against each retainer such that the side walls can be supported upright and said end walls are configured to be disposed within a space defined by said brace bars in a substantially parallel manner to form a rectangular space with said side walls for receiving snow to form a snow block.

In one embodiment, each side wall further includes a pair of channels, each channel disposed substantially along each side edge on the inside surface of each side wall and each end wall is configured to be coupled to the side walls by disposing each side edge of each end wall within one of the channels.

In one embodiment, each side wall further includes a pair of guides, each guide disposed substantially along each side edge on the inside surface of each side wall and each said end wall is configured to be coupled to the side walls by disposing each side edge of each end wall against each guide.

In one embodiment, the present snow block erector set further includes at least one stacking post configured to protrude from the top edge of each side wall and substantially in parallel configuration with the side edges of the side wall.

In one embodiment, the present snow block erector set further includes at least one stacking aperture disposed on the bottom edge of the each side wall, the at least one stacking aperture is configured to receive at least one stacking post of a snow block erector set disposed below the each side wall.

In one embodiment, a lock of each of the aperture and lock pairs is a slide bolt lock. In one embodiment, a lock of each of the aperture and lock pairs is a pin.

In one embodiment, at least one of the channels includes an elongated depressed path within which one of the side edges of one of the end walls is disposed.

In one embodiment, the present snow block erector set further includes a carry strap disposed on substantially on the top edge of on the outside surface of each of the side walls, wherein when the side walls are disposed symmetrically, with their inside surfaces facing one another, to dispose the carry straps in position for easy grasps of a user.

In one embodiment, each of the side walls includes a length and a width, the length ranges from about 18 inches to about 36 inches and the width ranges from about 12 inches to about 30 inches.

In one embodiment, each of the end walls further includes a length and width, the length ranges from about 12 inches to about 30 inches and the width ranges from about 12 inches to about 24 inches.

In one embodiment, at least one of the side walls and the end walls is constructed from a non-moisture absorbent material or a wooden material.

In one embodiment, the present snow block erector set further includes a compactor having an impact head and a handle extending from the impact head. The impact head is configured to be held at the handle for compacting snow disposed within the rectangular space.

In one embodiment, the inside surface of each side wall further includes at least one guide pin configured for supporting a divider disposed within the rectangular space.

In one embodiment, each side wall further includes a notch disposed on each side edge of each side wall and a brace having two notches, each notch of the brace is disposed substantially on one end of the brace and said the brace is configured to be removably coupled to the pair of side walls at their respective notches.

In accordance with the present invention, there is further provided a snow block erector set including:

(a) a pair of substantially rectangular side walls, each side wall having a top edge, a bottom edge, two side edges, an outside surface and an inside surface, each side edge of each side wall connecting one end of the top edge of each side wall to one end of the bottom edge of each side wall to form a top corner and a bottom corner, respectively, an aperture and lock pair disposed substantially on each top corner;

(b) a pair of substantially rectangular end walls, each end wall having two side edges;

(c) a pair of brace bars, each having two ends; and (d) a channel disposed substantially along each side edge on the inside surface of each side wall, wherein the side walls are configured to be aligned in parallel with their inside surfaces of the side walls facing one another and each aperture of one of the aperture and lock pairs of one side wall is substantially aligned with an aperture of one of the aperture and lock pairs of the other side wall, each end of each brace bar is configured to be inserted through one of the aligned apertures such that the side walls can be supported upright and each end wall is configured to be secured to the side walls by disposing each side edge of each end wall within one of the channels to form a rectangular space for receiving snow to form a snow block.

An object of the present invention is to provide a snow block erector set that can be used to form large snow blocks.

Another object of the present invention is to provide a snow block erector set that is easily transportable.

Another object of the present invention is to provide a snow block erector set that does not require the lifting of formed large snow blocks (in an effort to position the snow block at a desired location.

Another object of the present invention is to provide a snow block erector set that can be used to form multiple snow blocks at once.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 1 is a top perspective view of one embodiment of the present snow block erector set.

FIG. 2 is a top perspective view of one embodiment of the present snow block erector set, depicting guide pins configured for retaining end walls.

PARTS LIST

2—snow block erector set
4—side wall
6—end wall
8—brace bar
10—lock
12—lock shaft
14—handle
16—aperture for receiving brace bar
18—slot
20—guide
22—carry strap
24—stacking post
26—stacking aperture
28—bracket
30—holder
32—hole for receiving lock shaft
34—guide pin
36—snow block
38—snow seam
40—channel
42—length of side wall
44—width of side wall
46—width of end wall
48—length of end wall
50—impact head
52—handle
54—snow
56—divider
58—notch
60—brace
62—notch

PARTICULAR ADVANTAGES OF THE INVENTION

The present erector set aids one in forming large snow blocks expediently and easily. Multiple erector sets may be combined to construct large forms to receive snow to yield snow walls. The erector set can be used by a single individual without requiring additional tools for forming snow. The only tool that may be required is a tool for moving snow into the space formed of the erector set for receiving snow. The erector set does not need to be turned upside down to expel a formed block. A snow block can be and is preferably formed in place. The present erector set can be dismantled for transport by individuals or in vehicles and storage without taking up a significant amount of space.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 2A:
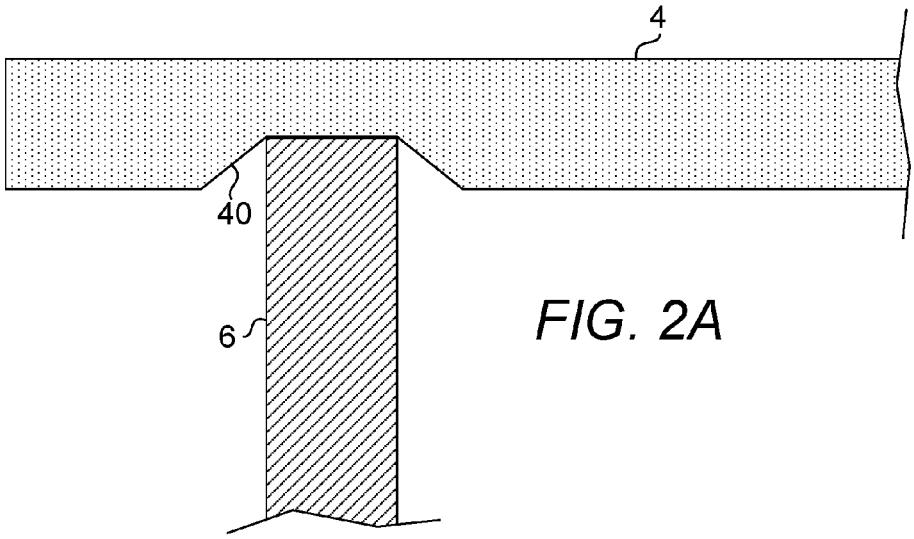
FIG. 2A is a partial top view of a top corner of a present snow block erector set depicting one embodiment of a channel within which an edge of an end wall is secured.

FIG. 1 is a top perspective view of one embodiment of the present snow block erector set 2. FIG. 2 is a top perspective view of one embodiment of the present snow block erector set 2, depicting guide pins 34 configured for retaining end walls 6. FIG. 2A is a partial top view of a top corner of a present snow block erector set 2 depicting one embodiment of a channel within which an edge of an end wall is secured. The snow block erector set 2 includes a pair of substantially rectangular side walls 4 having a length 42 and a width 44, a pair of substantially rectangular end walls 6, a pair of brace bars 8 and in one embodiment, a plurality of channels 40 for receiving side edges of end walls 6. Each side wall 4 includes a top edge, a bottom edge, two side edges, an outside surface and an inside surface. Each side edge of each side wall 4 connects one end of the top edge of the side wall to one end of the bottom edge of the side wall to form a top corner and a bottom corner, respectively. Each side wall 4 further includes an aperture 16 and lock 10 pair disposed substantially on a top corner. Each end wall 6 has two side edges. Each brace bar 16 has two ends. The length 42 of a side wall 4 preferably ranges from about 18 inches to about 36 inches and the width 44 of a side wall 4 preferably ranges from about 12 inches to about 30 inches.

The present snow block erector set 2 can function without channels that are disposed on the side walls when it is used to form snow blocks at a bottom course of a soft base. Without channels, the end walls are preferably urged down and lodged against the soft base for stability. Each channel 40 is disposed substantially along each of the side edges and on the inside surface of each of the side walls. In one embodiment (as shown in FIGS. 1 and 2), each channel is formed of a combination of a guide 20 and a guide pin 34 spaced apart laterally from the guide 20 to create a channel space within which one of the side edges of one of the end walls 6 is disposed. In one embodiment, only one guide pin 34 is used and biasly disposed toward the top edge of a side wall as the snow that is subsequently disposed in the space formed in an erected set tends to push the bottom portion of an end wall outwardly, negating the need for a guide pin for the bottom portion of the end wall. The guide pins 34 can also prevent installed end walls 6 from toppling towards themselves within the space outlined by the side and end walls 4, 6. Formed snow blocks may have inadvertent impressions left by these guide pins 34. However, these impressions are rather small and easily patched if the appearance of a smooth side surface of a snow block is intended.

In another embodiment, a channel 40 includes an elongated depressed path within which one of the side edges of one of the end walls 6 is disposed as shown in FIG. 2A. In this embodiment, the channel 40 is preferably shallow with its mouth tapering outwardly to avoid collection of snow and the need to remove snow collected from the channel 40 while in use. The use of channels 40 as shown in FIG. 2A eliminates the need for guides configured to hold end walls in place as collected snow within the space tends to urge against the end walls from within the space.

In use, the pair of side walls 4 are aligned side by side and in parallel with their inside surfaces of the facing one another and each aperture 16 of an aperture 16 and lock 10 pair substantially aligned with an aperture 16 of a corresponding side wall 4. The ends of each brace bar 8 are configured to be inserted through the aligned apertures 16 of the pair of side walls such that the pair of side walls can be supported upright. Upon securing the side walls with the brace bars 8, each end wall 6 is secured to the pair of side walls 4 by disposing each side edge of each end wall 6 within one of the channels 40 to form a rectangular space for receiving snow with four walls, i.e., two opposingly disposed side walls 4 and two opposingly disposed end walls 6.

In one embodiment, the present snow block erector set 2 further includes at least one stacking post 24 configured to protrude from the top edge of each side wall 4 and substantially in parallel configuration with the side edges of the side wall 4. In one embodiment, the present snow block erector set 2 further includes at least one stacking aperture 26 disposed on the bottom edge of the each side wall 4. Each stacking aperture 26 is configured to receive at least one stacking post 24 of a snow block erector set 2 disposed below the side wall 4.

In one embodiment, a lock of each of the aperture 16 and lock 10 pairs is a slide bolt lock as shown in FIGS. 1-2, 3 and 4-6. A slide bolt lock essentially includes a lock shaft 12 configured for slidable movement in a path bounded by one or more holders 30 and can assume a locked position and an unlocked position and a handle 14 for facilitating manipulation of the lock shaft 12. In the embodiments shown in FIGS. 1-2, 3 and 4-7, a locked position is achieved when a lock shaft 12 is inserted or engaged in a retainer, e.g., a hole 32, disposed substantially on one end of a brace bar 8, serving as a travel limit to prevent movement of the corresponding top corner of a side wall 4 from sliding off of the end of the brace bar 8. With a slide bolt lock, the locking mechanism is already made available and attached to the side wall such that a user of a set 2 does not need to locate such part during use. In another embodiment, a lock of each of the aperture and lock pairs is a pin for insertion and removable retention within a hole 32. The pin can additionally be tethered to a side wall 4 to ensure the pin is in close proximity and ready for use when it is needed.

In one embodiment, the present snow block erector set further includes a carry strap 22 disposed substantially on the top edge of on the outside surface of each of the side walls 4. In transporting the present erector set 2, the side walls 4 are brought close together and disposed symmetrically, with their inside surfaces facing one another, to dispose the carry straps 22 in a position for easy grasps of a user's hand.

Figure 3:
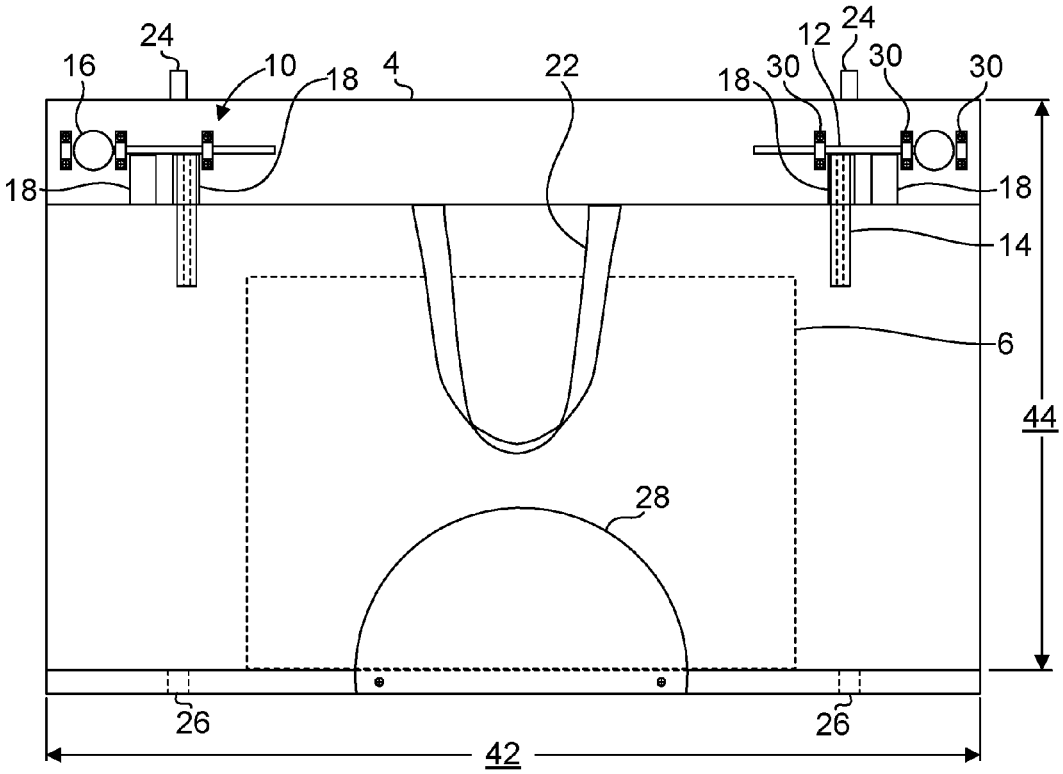
FIG. 3 is a side view of one embodiment of a side wall of the present snow block erector set, depicting the lock in an unlocked position.
Figure 3A:
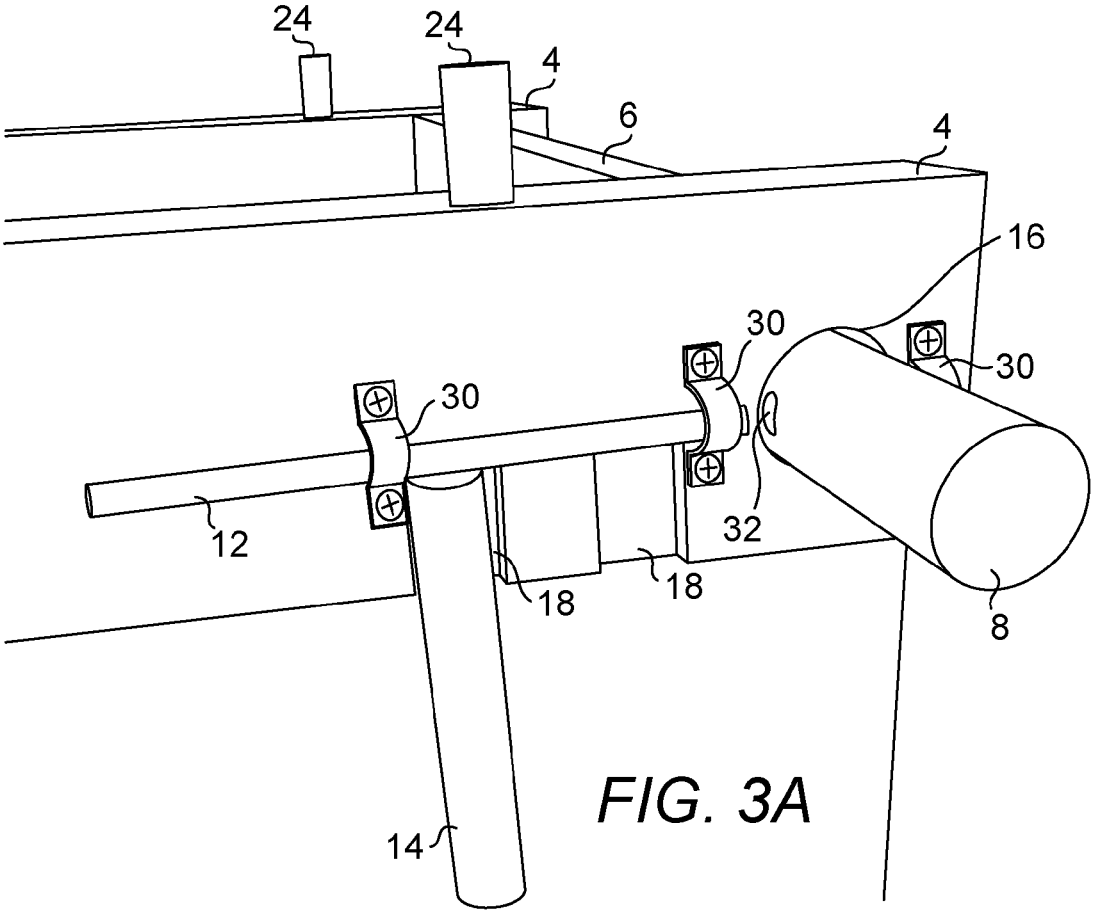
FIG. 3A is a partial top perspective view of one top corner of a present snow block erector set, depicting a corner that is unlocked.

FIG. 3 is a side view of one embodiment of a side wall of the present snow block erector set, depicting the lock in an unlocked position. FIG. 3A is a partial top perspective view of one top corner of a present snow block erector set, depicting a corner that is unlocked. It shall be noted in the unlocked position, the handle 14 may be tucked in a slot 18 neatly just as it may in the locked position, e.g., as shown in FIGS. 1 and 2. It may also be shown that when not in use, one or more end walls 6 may be tucked in the space between a bracket 28 and an outside surface of a side wall 4 such that they may be transported or stored along with the side wall 4.

Figure 4:
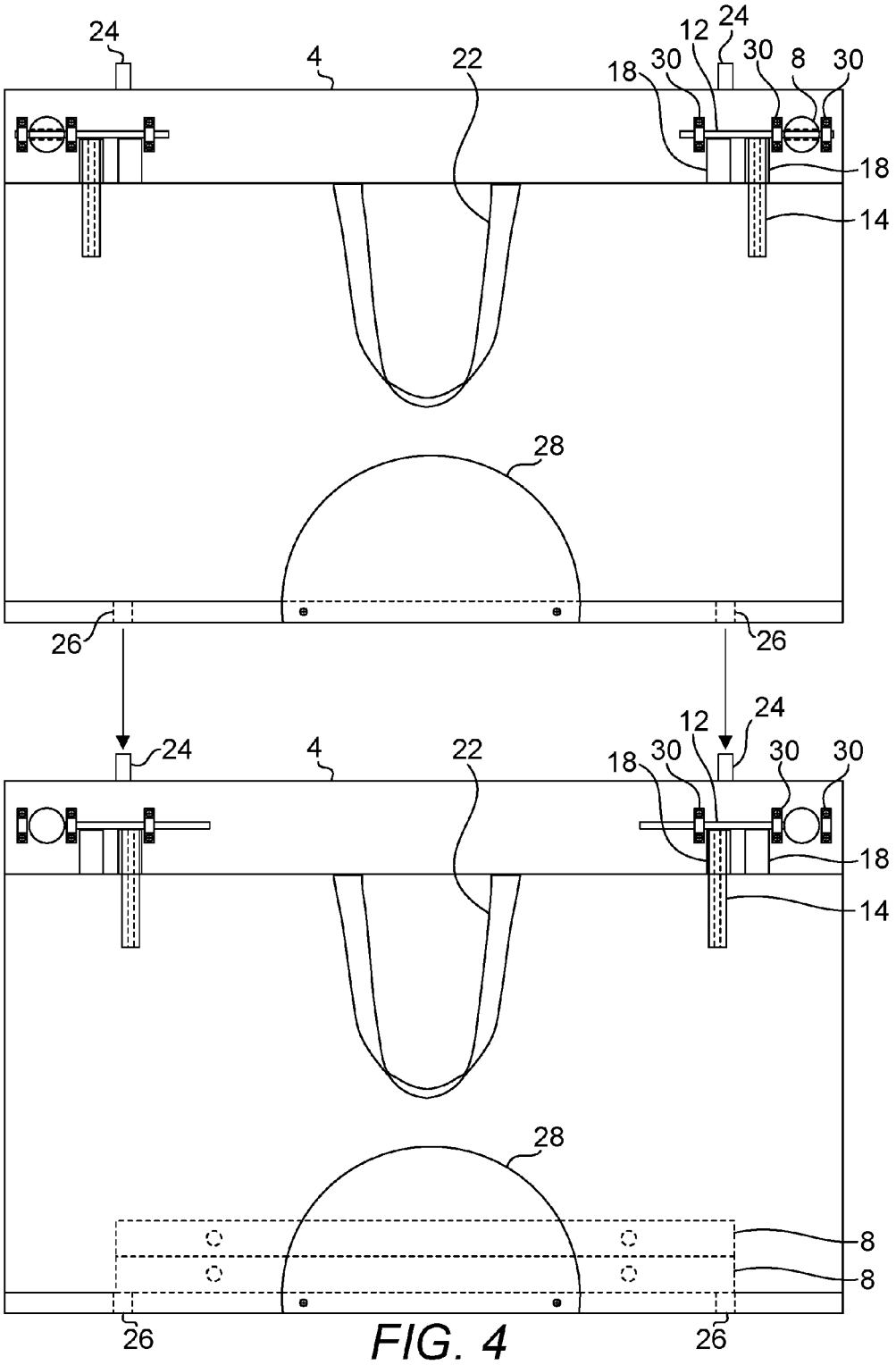
FIG. 4 is a side view of two snow block erector sets, depicting the top snow block erector set aligned to be lowered and engaged with the bottom snow block erector set.

FIG. 4 is a side view of two snow block erector sets, depicting the top snow block erector set aligned to be lowered and engaged with the bottom snow block erector set.

Figure 5:
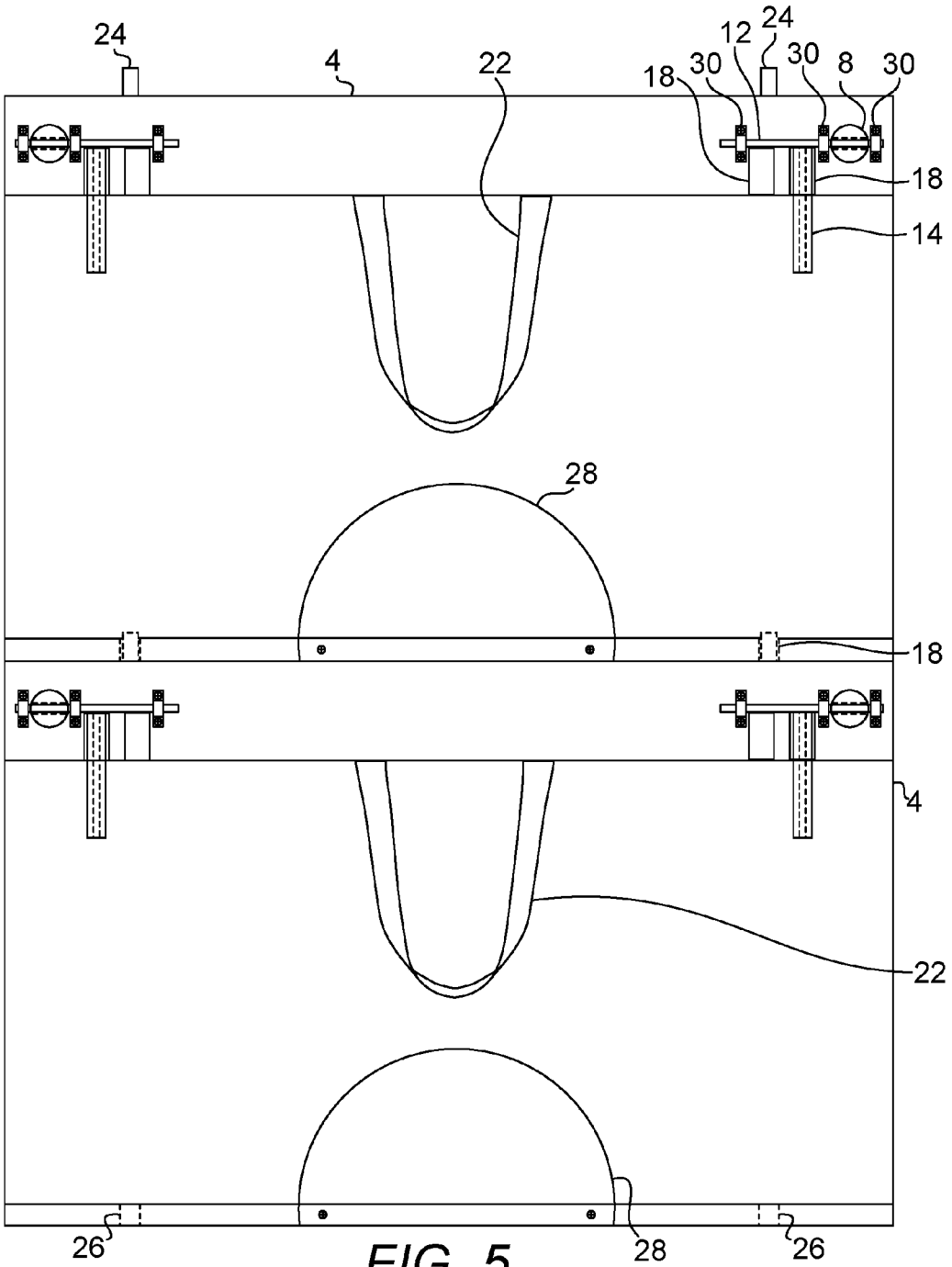
FIG. 5 is a side view of two snow block erector sets, depicting the top snow block having been lowered and engaged with the bottom snow block erector set to form a snow block erector set twice the height of as achieved using only one snow block erector set.

FIG. 5 is a side view of two snow block erector sets, depicting the top snow block having been lowered and engaged with the bottom snow block erector set to form a snow block erector set twice the height as achieved using only one snow block erector set. It can be seen that, in order to build a snow block that is even taller, one or more sets 2 may be stacked atop the two already stacked sets 2. It is also conceivable that, in order to build blocks in the lengthwise direction of the already built blocks, one or more sets 2 may be further erected. In connecting one or more new blocks to one or more existing blocks laterally, one of the end walls 6 of each newly erected set 2 will not be used such that newly poured snow in each newly erected set can be formed to connect with existing blocks.

Figure 6:
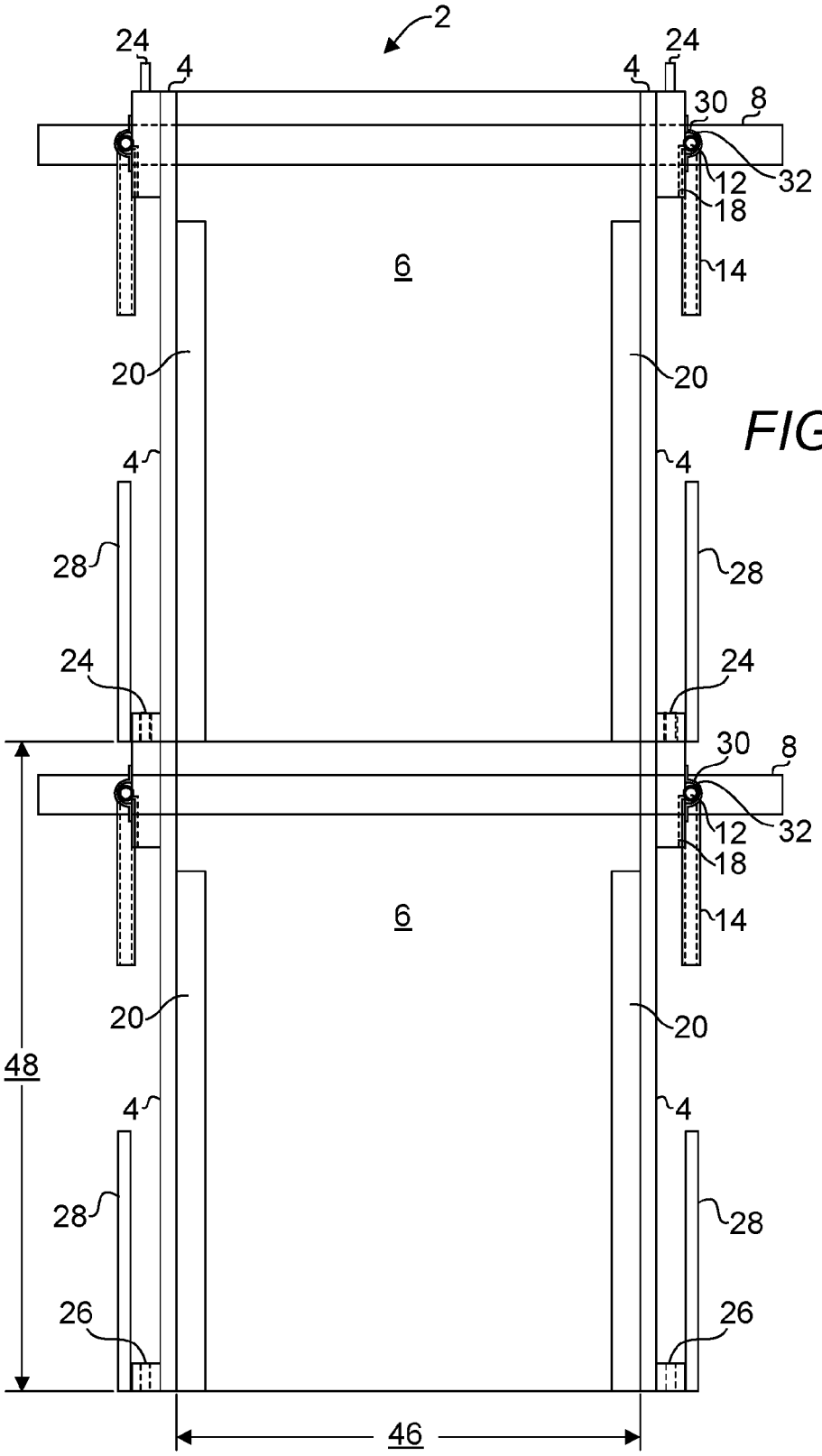
FIG. 6 is an end view of two stacked snow block erector sets.

FIG. 6 is an end view of two stacked snow block erector sets 2. Each of the substantially rectangular end walls 6 includes a length 48 and width 46. The length 48 of each end wall 6 ranges from about 12 inches to about 30 inches and the width 46 of each end wall 6 ranges from about 12 inches to about 24 inches.

Figure 7:
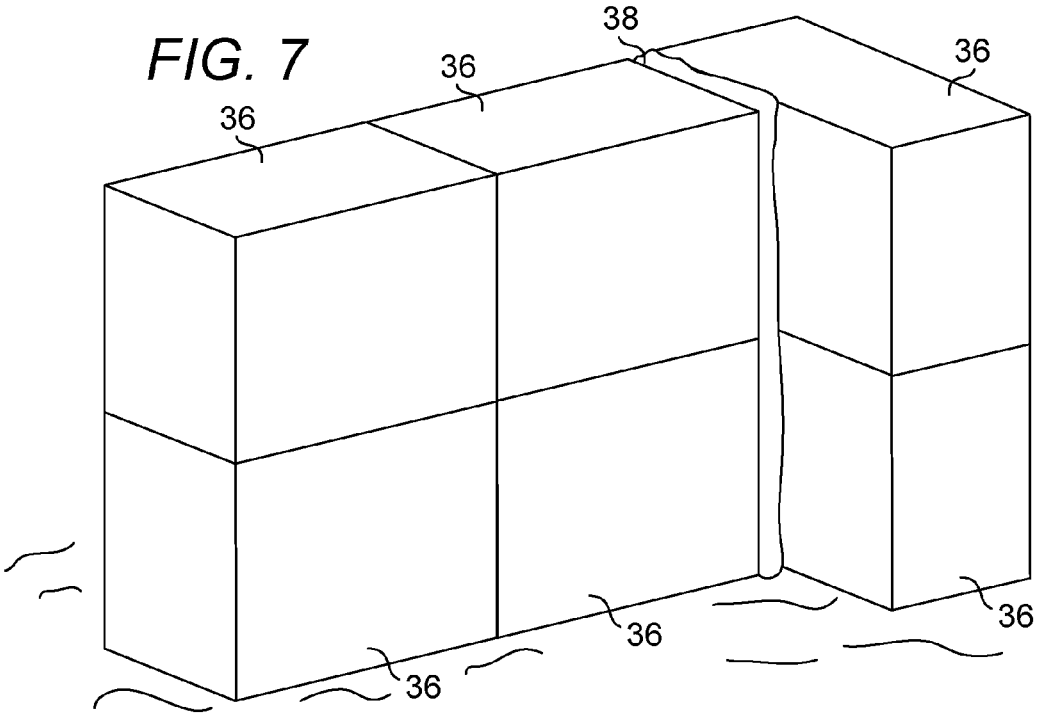
FIG. 7 is a top perspective view of snow blocks formed using one or more present snow block erector sets.

FIG. 7 is a top perspective view of snow blocks formed using one or more present snow block erector sets. In this example, a total of six blocks have been formed. Four of the six blocks 36 are formed in a first plane and two 36 are formed in a second plane that is roughly perpendicular to the first plane. This structure may be formed using only one erector set or multiple erector sets. Multiple erector sets may be erected first such that the spaces formed of erected sets can be filled all at once or one erector may be used at a time to construct one snow block at a time to add to the structure. As disclosed elsewhere herein, laterally constructed snow blocks may be built with laterally disposed blocks in contacting fashion. However, for the two blocks which are disposed at about right angle to the four blocks, depending on the sequence in which the groups of blocks was built, space may need to be allocated between the two groups as the length of an individual block differs from the width of an individual block. Therefore, all walls 4, 6 of an erector set 2 may be required in constructing an adjoining block that is not geared towards extending the existing blocks laterally, e.g., when the groups of four blocks is constructed first. However, this is not a concern as loose snow may be used to fill the gap to form a seam 38 to close the gap between the two groups if desired. If the group of two blocks had been constructed first, no seam will be necessary as one or two blocks of the group of four blocks simply extend from the group of two blocks without the use of an end wall as disclosed elsewhere herein. A present erector set is preferably assembled in place as there are components of the erectors that are not securely attached to one another to allow such erected set to be assembled at one location and moved to a second location for use. In some instances, in using more than one erector set as a single construction unit, a first erector set is preferably filled first to provide sufficient weight and integrity to the erector set such that a second erector set that is assembled on top of the first may already have a strong base to support the second erector set and the block that is being built on top of the first bottom block. In forming a block, snow is incrementally dumped and compacted, e.g., with a shovel, in the space formed from the side and end walls. When the space is sufficiently filled and the snow compacted, the assembly may be dismantled by first unlocking the brace bars such that the brace bars may be released from the side walls. The end walls may then be readily removed as they will have no support once the side walls have been removed.

In one embodiment, at least one of the substantially rectangular side walls and the substantially rectangular end walls is constructed from a non-moisture absorbent material, e.g., polycarbonate or another plastic material. Although less desirably so, the side walls may alternatively be constructed from a wooden material, e.g., plywood. Although the present erector set is configured for the purpose of holding snow, it is conceivable that the erector can be used as a form for concrete, foam and other materials.

Figure 8:
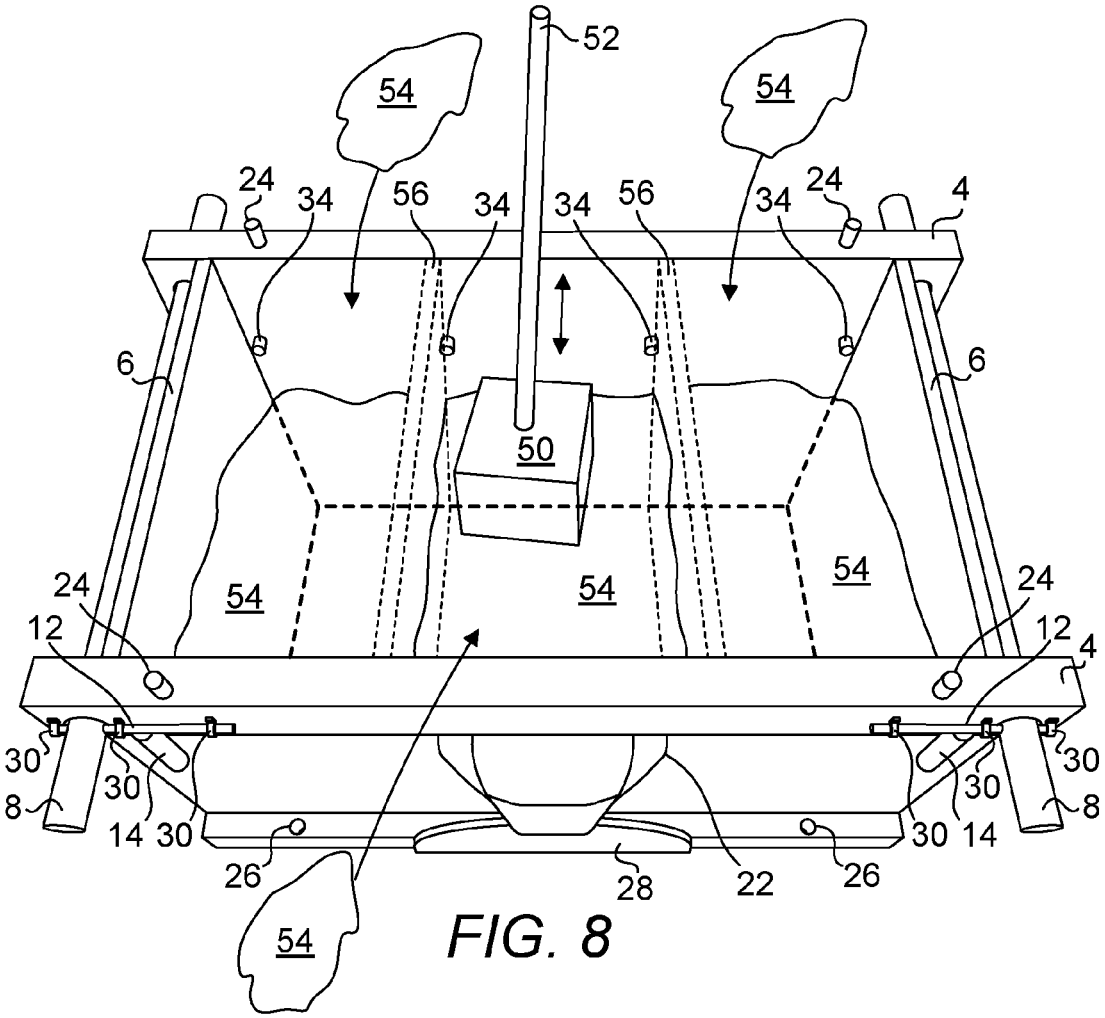
FIG. 8 is a top perspective view of one embodiment of the present snow block erector set, depicting guide pins configured for retaining end walls and supporting dividers.

FIG. 8 is a top perspective view of one embodiment of the present snow block erector set, depicting guide pins 34 configured for retaining end walls 6 and supporting dividers 56. If a large snow block is unnecessary or if smaller snow blocks are desired, the space within the snow block erector set may be subdivided using one or more dividers 56. As shown herein, with two dividers 56, three smaller snow blocks may be formed. Upon being formed, the smaller blocks may be moved and used elsewhere. Further disclosed is a compactor useful for compacting the snow 54 placed within the erector set such that formed blocks can be made denser and stronger. In use, the handle 52 of the compactor is simply held in a hand of a user with its impact head 50 impacted repeatedly against the snow 54 disposed within the erector set.

Figure 9:
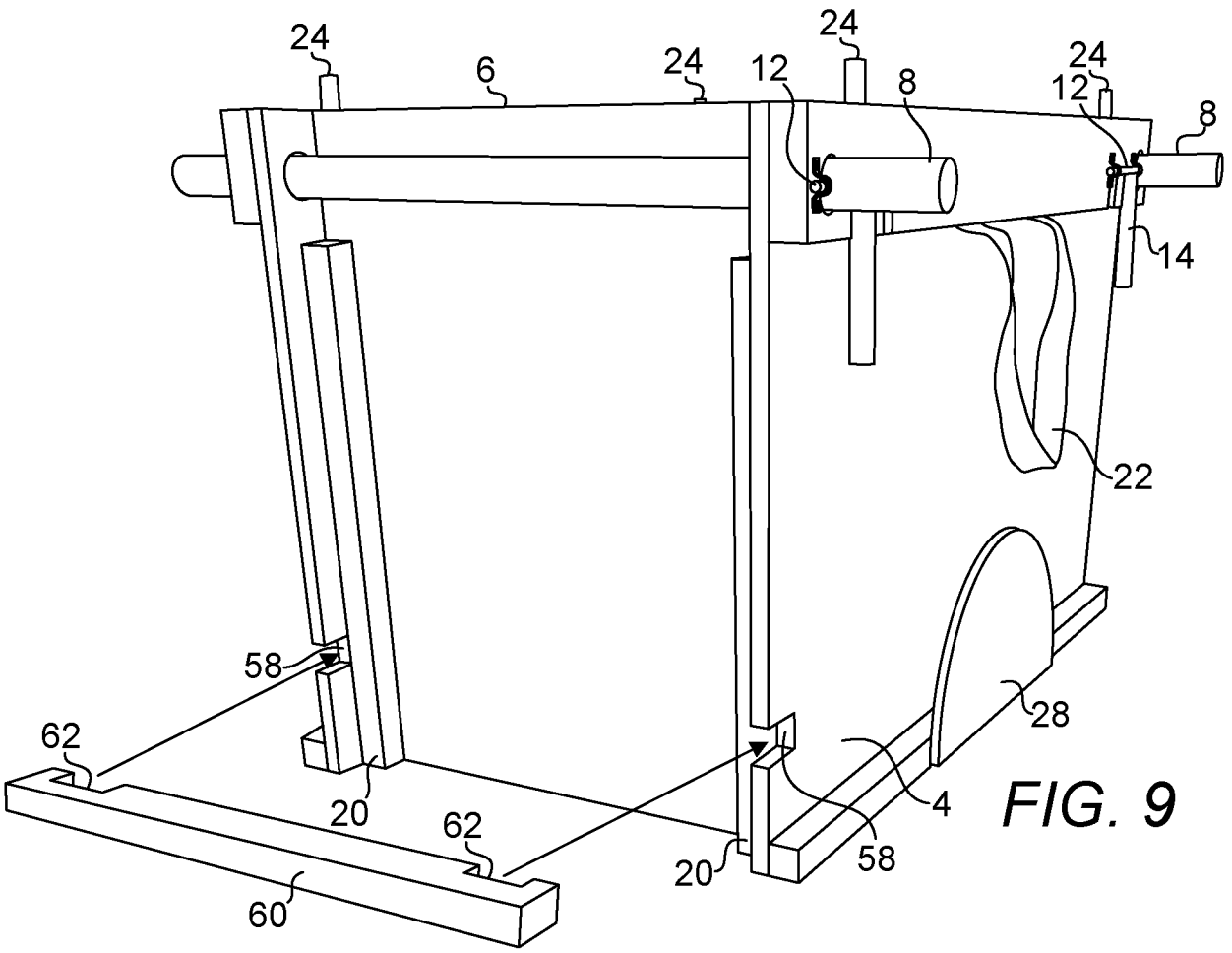
FIG. 9 is a top perspective view of one embodiment of the present snow block erector set depicting a brace configured for further securing one end of the present snow block erector set.
Figure 10:
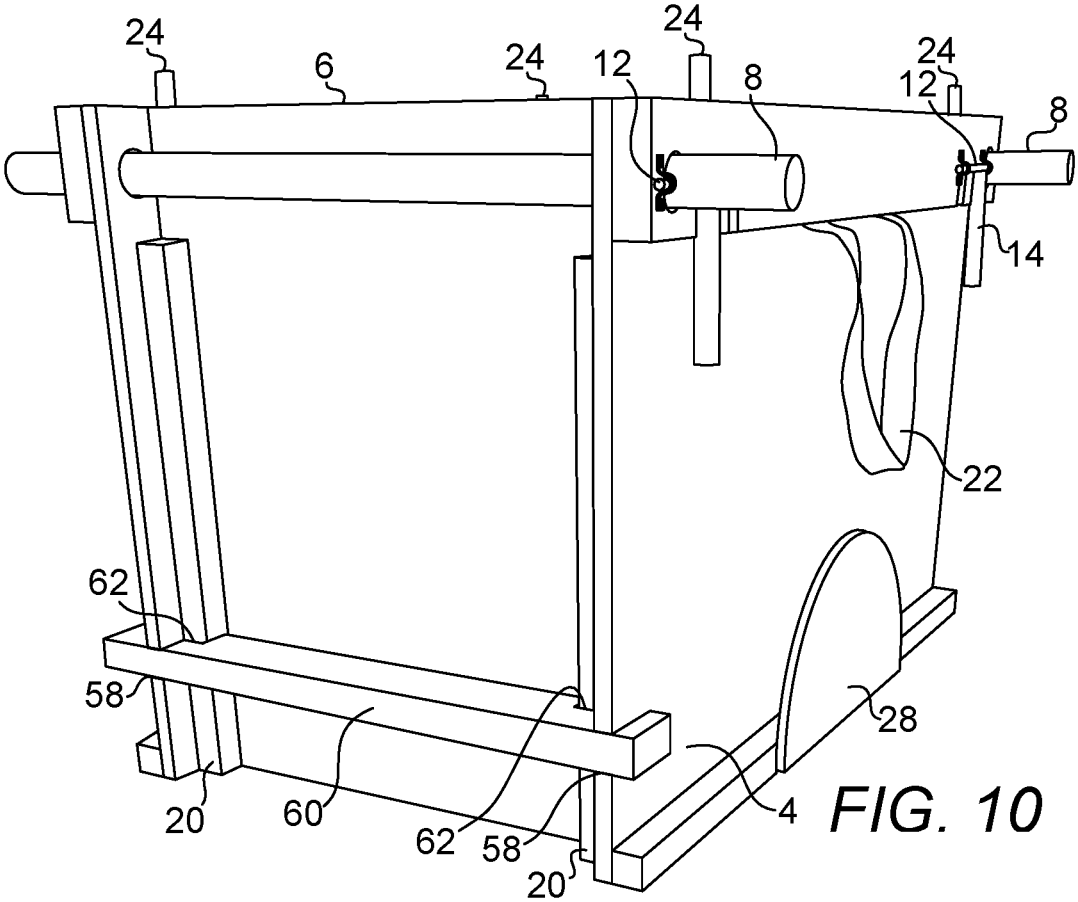
FIG. 10 is a top perspective view of one embodiment of the present snow block erector set depicting a brace having been disposed at one end of the present snow block erector set to secure the same.

FIG. 9 is a top perspective view of one embodiment of the present snow block erector set depicting a brace 60 configured for further securing one end of the present snow block erector set. FIG. 10 is a top perspective view of one embodiment of the present snow block erector set depicting a brace 60 having been disposed at one end of the present snow block erector set to secure the same. In this embodiment, a notch 58 is disposed on each side edge of a side wall 4. It shall be noted that such notches 58 are only shown on one end of the erector set. Such features can easily be applied to the opposite end of the erector set. In securing the side walls at one end of the erector set, a brace 60 is provided. The brace 60 is essentially a bar having two notches 62, each configured to be removably coupled to a notch 58 of a side wall. Each brace 60 adds stability to the erector set, especially when it is filled with snow, thereby allowing thinner and hence lighter side walls to be utilized.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A snow block erector set comprising:

(a) a pair of substantially rectangular side walls, each side wall having a top edge, a bottom edge, two side edges, an outside surface and an inside surface, each side edge of said each side wall connecting one end of said top edge of said each side wall to one end of said bottom edge of said each side wall to form a top corner and a bottom corner, respectively, an aperture and lock pair disposed substantially on each said top corner;

(b) a pair of substantially rectangular end walls, each end wall having two side edges; and (c) a pair of brace bars, each brace bar having two ends and two retainers, each retainer disposed substantially on one of said two ends of said each brace bar, wherein said side walls are configured to be aligned in parallel with their inside surfaces facing one another and each aperture of one of said aperture and lock pairs of one of said side walls is substantially aligned with an aperture of one of said aperture and lock pairs of the other one of said side walls, each end of said each brace bar is configured to be inserted through one of said aligned apertures and removably secured in place with a lock of each said aperture and lock pair deployed against each said retainer such that said side walls are supported upright and said end walls are configured to be disposed within a space defined by said brace bars in a substantially parallel manner to form a rectangular space with said side walls for receiving snow to form a snow block.

2. The snow block erector set of claim 1, wherein each said side wall further comprises a pair of channels, each channel disposed substantially along each said side edge on said inside surface of each said side wall and each said end wall is configured to be coupled to said side walls by disposing each said side edge of each said end wall within one of said channels.

3. The snow block erector set of claim 2, wherein at least one of said channels comprises an elongated depressed path within which one of said side edges of one of said end walls is disposed.

4. The snow block erector set of claim 1, wherein each said side wall further comprises a pair of guides, each guide disposed substantially along each said side edge on said inside surface of each said side wall and each said end wall is configured to be coupled to said side walls by disposing each said side edge of each said end wall against each said guide.

5. The snow block erector set of claim 1, further comprising at least one stacking post configured to protrude from a top edge of at least one of said side walls and substantially in parallel configuration with said side edges of said at least one of said side walls.

6. The snow block erector set of claim 1, further comprising at least one stacking aperture disposed on said bottom edge of said each side wall, said at least one stacking aperture is configured to receive at least one stacking post of a snow block erector set disposed below said each side wall.

7. The snow block erector set of claim 1, wherein a lock of each of said aperture and lock pairs is a slide bolt lock.

8. The snow block erector set of claim 1, wherein a lock of each of said aperture and lock pairs is a pin.

9. The snow block erector set of claim 1, further comprising a carry strap disposed substantially on said top edge of on said outside surface of each of said side walls, wherein said side walls are disposed symmetrically, with their inside surfaces facing one another, to dispose the carry straps in position for easy grasps of a user.

10. The snow block erector set of claim 1, wherein each of said side walls further comprises a length and width, said length of each of said side walls ranges from about 18 inches to about 36 inches and said width of each of said side walls ranges from about 12 inches to about 30 inches.

11. The snow block erector set of claim 1, wherein each of said end walls further comprises a length and a width, said length of each of said end walls ranges from about 12 inches to about 30 inches and said width of each of said end walls ranges from about 12 inches to about 24 inches.

12. The snow block erector set of claim 1, wherein at least one of said side walls and said end walls is constructed from a material selected from the group consisting of a non-moisture absorbent material and a wooden material.

13. The snow block erector set of claim 1, further comprising a compactor comprising an impact head and a handle extending from said impact head, wherein said impact head is configured to be held at said handle for compacting snow disposed within the rectangular space.

14. The snow block erector set of claim 1, wherein the inside surface of each of said side walls further comprises at least one guide pin configured for supporting a divider disposed within the rectangular space.

15. The snow block erector set of claim 1, wherein each said side wall further comprises a notch disposed on a side edge of each said side wall and a brace having two notches, each said notch of said brace is disposed substantially on one end of said brace and said brace is configured to be removably coupled to said pair of side walls at their respective notches.

16. A snow block erector set comprising:

(a) a pair of substantially rectangular side walls, each side wall having a top edge, a bottom edge, two side edges, an outside surface and an inside surface, each side edge of said each side wall connecting one end of said top edge of said each side wall to one end of said bottom edge of said each side wall to form a top corner and a bottom corner, respectively, an aperture and lock pair disposed substantially on each said top corner;

(b) a pair of substantially rectangular end walls, each end wall having two side edges;

(c) a pair of brace bars, each having two ends; and (d) a channel disposed substantially along each said side edge on said inside surface of each said substantially rectangular side wall, wherein said side walls are configured to be aligned in parallel with their inside surfaces facing one another and each aperture of one of said aperture and lock pairs of one of said side walls is substantially aligned with an aperture of one of said aperture and lock pairs of the other one of said side walls, each end of said each brace bar is configured to be inserted through one of said aligned apertures such that said side walls can be supported upright and each of said end walls is configured to be secured to said side walls by disposing each said side edge of each said end wall within one of said channels to form a rectangular space for receiving snow to form a snow block.

17. The snow block erector set of claim 16, further comprising at least one stacking post configured to protrude from a top edge of at least one of said side walls and substantially in parallel configuration with said side edges of said at least one of said side walls.

18. The snow block erector set of claim 16, further comprising at least one stacking aperture disposed on said bottom edge of said each side wall, said at least one stacking aperture is configured to receive at least one stacking post of a snow block erector set disposed below said each side wall.

19. The snow block erector set of claim 16, wherein a lock of each of said aperture and lock pairs is a slide bolt lock.

20. The snow block erector set of claim 16, wherein the inside surface of each of said side walls further comprises at least one guide pin configured for supporting a divider disposed within the rectangular space.

* * * * *